US009512741B2

(12) United States Patent
Myogan et al.

(10) Patent No.: US 9,512,741 B2
(45) Date of Patent: Dec. 6, 2016

(54) POWER PLANT

(75) Inventors: Ichiro Myogan, Kanagawa (JP); Hiroaki Shibata, Kanagawa (JP); Yoshitaka Kawahara, Kanagawa (JP); Isamu Osawa, Kanagawa (JP); Kokan Kubota, Kanagawa (JP)

(73) Assignee: FUJI ELECTRIC CO., LTD., Kanagawa (JP)

( * ) Notice: Subject to any disclaimer, the term of this patent is extended or adjusted under 35 U.S.C. 154(b) by 223 days.

(21) Appl. No.: 14/237,393

(22) PCT Filed: Aug. 16, 2012

(86) PCT No.: PCT/JP2012/070791

§ 371 (c)(1),
(2), (4) Date: Feb. 6, 2014

(87) PCT Pub. No.: WO2013/027643

PCT Pub. Date: Feb. 28, 2013

(65) Prior Publication Data

US 2014/0190165 A1 Jul. 10, 2014

(30) Foreign Application Priority Data

Aug. 19, 2011 (JP) ..... 2011-179444

(51) Int. Cl.
*F01K 25/08* (2006.01)
*F01K 19/00* (2006.01)
(Continued)

(52) U.S. Cl.
CPC ..... *F01K 25/08* (2013.01); *F01K 9/00* (2013.01); *F01K 9/023* (2013.01); *F01K 19/00* (2013.01)

(58) Field of Classification Search
CPC ..... F01K 19/00–19/10
(Continued)

(56) References Cited

U.S. PATENT DOCUMENTS 4,576,007 A * 3/1986 Arakawa ..... F01K 13/02 60/652
5,005,351 A * 4/1991 Archer ..... F28B 1/02 60/657

(Continued)

FOREIGN PATENT DOCUMENTS

JP S5591713 A 7/1980
JP S57124078 A 8/1982

(Continued)

OTHER PUBLICATIONS

International Search Report PCT/JP2012/070791 dated Nov. 13, 2012, with English Translation.

(Continued)

*Primary Examiner* — Thomas Denion
*Assistant Examiner* — Mickey France
(74) *Attorney, Agent, or Firm* — Young & Thompson

(57) ABSTRACT

A binary power generation device is equipped with the flow path of a medium circulating through a heat exchanger, a turbine, a condenser, and a pump. A method for removing air that has intruded into the flow path of the medium includes: an air intrusion detection step of calculating, based on the pressure and temperature of a gas retaining portion communicatively connected to the flow path of the medium, a pressure threshold value obtained by adding the saturated vapor pressure of the medium and a margin value and of detecting, by comparing the pressure of a gas phase portion with the pressure threshold value, that air has intruded into the medium; a medium liquefaction step of producing a gas by pressurizing a mixed gas of the medium and air to reduce the amount of the medium in the mixed gas; and an exhaust step of exhausting the gas.

9 Claims, 6 Drawing Sheets

(51) Int. Cl.
*F01K 9/02* (2006.01)
*F01K 9/00* (2006.01)

(58) Field of Classification Search
USPC ..... 60/685–697
See application file for complete search history.

(56) References Cited

U.S. PATENT DOCUMENTS 5,095,706 A * 3/1992 Saito ..... F01K 9/00 60/646
5,113,927 A 5/1992 Kedar et al.
5,119,635 A 6/1992 Harel
5,487,765 A 1/1996 Kedar et al.
5,664,419 A * 9/1997 Kaplan ..... F03G 7/04 60/641.2
2007/0234750 A1 10/2007 Kalina
2010/0326075 A1* 12/2010 Fong ..... F01K 25/06 60/650
2011/0048009 A1* 3/2011 Smith ..... F01K 7/02 60/645
2011/0048012 A1* 3/2011 Ernst ..... F01K 9/003 60/651

FOREIGN PATENT DOCUMENTS

| | | |
|---|---|---|
| JP | 61-076707 | 4/1986 |
| JP | 62-26304 | 2/1987 |
| JP | 3-111605 | 5/1991 |
| JP | H03111606 A | 5/1991 |
| JP | 06-300393 | 10/1994 |
| JP | 2003-120513 | 4/2003 |
| JP | 2007-262909 | 10/2007 |
| WO | 2007117619 | 10/2007 |

OTHER PUBLICATIONS

JP Office Action, dated Feb. 9, 2016; Application No. 2013-529982.

Japanese Office Action dated Aug. 16, 2016; Application No.: 2013-529982.

* cited by examiner

POWER PLANT

TECHNICAL FIELD

The present invention relates to a power plant using a medium having a lower boiling point than water as a working medium, equipped with an air removing device which removes an air intruding into the working medium.

BACKGROUND ART

A power plant, using a low boiling point medium, for recovering heat energy from a low-temperature heat source which has not been utilized in conventional geothermal power generation using a steam turbine and for generating a power has attracted special attention as an energy recovery device recently (see Patent Literature 1).

FIG. 7 shows a basic system diagram of a conventional power plant using a low boiling point medium. This power plant exchanges heat between a medium having a lower boiling point than water and a heat source by a vaporizer 100 to evaporate this medium, rotates a turbine 101 by this medium vapor, and operates an electric generator 102 by the rotational force, thereby obtaining a power. The medium exiting from the turbine is condensed by a condenser 103 and is delivered back to the vaporizer 100 via a preheater 105 by a circulation pump 104. Then, the above cycle is repeated.

In general, when a medium with a high vapor pressure (i.e., a low boiling point) is used, vaporization by the vaporizer is easy but condensation by the condenser is difficult. To the contrary, when a medium with a low vapor pressure (i.e., a high boiling point) is used, vaporization is difficult but condensation is easy. From this point of view, a medium which maximizes an enthalpy difference (heat difference) between a turbine inlet and a turbine outlet is selected as a medium to be used. For example, n-pentane ($nC_5H_{12}$) is mainly used as a natural medium used in a condition where a temperature of a geothermal heat source is from 130° C. to 140° C. and a temperature of a cooling source is from 15° C. to 30° C.

The cooling source of the condenser is generally circulating cooling water or an atmosphere. Therefore, the temperature of the cooling source is largely different between winter and summer. Thus, in a case where the condenser is designed only based on a cooling performance required in summer, the cooling performance of the condenser is further enhanced when the temperature of the cooling source drops in winter.

As shown in FIG. 4, however, the vapor pressure of n-pentane falls to 101 kPa or lower when its temperature falls to 36° C. or lower. Therefore when the temperature of the outlet of the condenser drops to 36° C. or lower in winter, a medium flow path may be the atmospheric pressure or lower. In this case, it is likely that an air intrudes into the medium flow path from the main body of the condenser and various joints of a connection pipe of the condenser or a mechanically sealed portion of the turbine shaft, for example.

Thus, as a device for removing the air intruding the medium in a plant related to power generation, Patent Literatures 2 to 6 described below are known.

Patent Literature 2 discloses a binary power plant using water instead of a low boiling point medium, equipped with an air extraction device for extracting an air from drain water of a condenser.

Patent Literature 3 discloses a power system including a power cycle circuit 10 which circulates a working fluid in which a high boiling point medium and a low boiling point medium are mixed through a vapor generator 1 for heating a solution of the working fluid and generating a vapor, a steam turbine 2 which is driven by the vapor supplied by the vapor generator 1, a condenser 3 for cooling the vapor released from the steam turbine to condense it to the solution, and a feed pump 16 for supplying the solution supplied from the condenser 3 to the vapor generator 1, in that order, wherein a concentration of the low boiling point medium of the working fluid in the condenser 3 is determined to provide a pressure around the atmospheric pressure as the lowest pressure which can be generated in the condenser 3 in the power cycle circuit 10.

Patent Literature 4 discloses a plant which includes a chamber having a piston therein provided above an upper portion of a condenser, a valve connecting a space below the piston in the chamber to the condenser, a cooling means cooling a lower portion of the chamber by a coolant through a wall, and a discharge valve connected to the lower portion of the chamber.

Patent Literatures 5 and 6 disclose a plant including: a tightly sealed chamber above an upper portion of a condenser, the chamber being provided with a movable diaphragm for dividing the inside of the chamber into an upper portion and a lower portion; two flow rate control valves arranged between the condenser and the lower portion of the chamber in series; a cooling means for cooling the lower portion of the chamber with a coolant through a wall; and a discharge valve connected to the lower portion of the chamber.

PRIOR ART DOCUMENTS

Patent Literature (PTL)

PTL 1: JP S62-26304
PTL 2: JP 2003-120513
PTL 3: JP 2007-262909
PTL 4: U.S. Pat. No. 5,119,635
PTL 5: U.S. Pat. No. 5,113,927
PTL 6: U.S. Pat. No. 5,487,765

SUMMARY OF INVENTION

Problem(s) to be Solved by the Invention

Patent Literature 2 described above uses water as the medium and therefore requires the heat source of 100° C. or more. Thus, there is a problem that it cannot use a lower-temperature heat source.

Patent Literature 3 described above has problems that the pressure in the condenser increases in summer and the heat generation efficiency is reduced, because the concentration of the low boiling point medium is determined to provide a pressure around the atmospheric pressure as the lowest pressure which can be generated in the condenser in winter.

Patent Literatures 4, 5, and 6 described above disclose the plant for removing the air from the medium, but merely refer to an example in which the plant is regularly operated every 20 minutes as an operation timing of the plant. Thus, there is a problem that an outflow of the medium increases because the air removing operation is performed more than necessary.

In view of the above problems, it is an object of the present invention to provide a power plant equipped with an intruding air removing device which can detect an air intruding into a medium flow path of the power plant without stopping the power plant and reduce the amount of a working medium exhausted to the outside of the plant.

Means to Solve the Problem(s)

To achieve the aforementioned object, the present invention is characterized in that, in a power plant including: a heat exchanger configured to exchange heat between a medium having a lower boiling point than water and a heat source to generate a medium gas; a turbine configured to receive a pressure of the medium gas supplied from the heat exchanger to rotate; an electric generator configured to be connected to the turbine; a condenser configured to cool the medium gas discharged from the turbine; a circulation pump configured to supply the medium released from the condenser to the heat exchanger; a medium flow path configured to pass through the heat exchanger, the turbine, the condenser, and the circulation pump; and an air removing device configured to remove an air intruding into the medium, the air removing device includes: a gas retaining portion provided on an outlet side of the condenser and configured to retain a gas in the medium; a pressure gauge configured to measure a pressure in the gas retaining portion; a thermometer configured to measure a temperature in the gas retaining portion; a controller configured to calculate a pressure threshold value based on a saturated vapor pressure value of the medium calculated using the temperature of the thermometer, and compare a pressure value of the pressure gauge and the pressure threshold value to determine whether or not an air has intruded into the medium; and a release means configured to release the gas in the gas retaining portion in a case where it is determined that the air has intruded.

The release means includes: a first chamber to which the gas retained in the gas retaining portion is transferred in a case where the controller determines that the air has intruded; and a medium supply means configured to supply a liquid medium to the first chamber so that the gas is compressed. The gas remaining in the first chamber is released after the medium is supplied.

The medium supply means may include a liquid medium tank configured to store the liquid medium and a liquid medium feed pump configured to supply the liquid medium from the liquid medium tank to an inside of the first chamber. Also, the medium supply means may include a valve provided in the medium flow path on an outlet side of the circulation pump, a branching pipe configured to branch from a pipe between the circulation pump and the valve and connect to the first chamber, and another valve provided in the branching pipe, and when determining intrusion of the air, the controller may control the valve provided in the medium flow path on the outlet side of the circulation pump to be closed and the other valve provided in the branching pipe to be opened.

The release means is characterized by including: a first valve provided in a pipe connecting the gas retaining portion and a lower portion of the first chamber; a second valve provided in a pipe connecting the liquid medium feed pump and the first chamber; a third valve provided in a pipe connecting an upper portion of the first chamber to a second chamber; a fourth valve configured to release the gas from the second chamber; and a fifth valve provided in a pipe connecting the gas retaining portion to the upper portion of the first chamber.

The controller is characterized by, when determining that the air has intruded, controlling the second valve and the third valve to be closed and the first valve and the fifth valve to be opened so that the gas in the gas retaining portion is transferred to the first chamber, and then controlling the first valve and the fifth valve to be closed, the second valve to be opened, and the liquid medium feed pump to supply the liquid medium to the first chamber so that the gas is compressed, and subsequently controlling the third valve to be opened while the fourth valve is closed so that the gas in the first chamber is transferred to the second chamber, and then controlling the third valve to be closed and the fourth valve to be opened so that the gas in the second chamber is released to an outside of the second chamber.

The power plant may further include: a combustor configured to burn the medium remaining in the gas released from the second chamber; and an air supply portion configured to supply an air to the combustor. Furthermore, a sixth valve may be provided in a pipe connecting to the combustor and the air supply portion to each other, and the controller may control opening degrees of the fourth valve and the sixth valve to adjust a flow rate.

The controller preferably determines that the air has intruded when the pressure value of the pressure gauge is larger than the pressure threshold value which is preferably calculated by adding a margin value to the saturated vapor pressure value. The margin value is a preset fixed value or a proportional value obtained by multiplying the saturated vapor pressure value by a coefficient.

Furthermore, it is preferable that a spray nozzle is provided for spraying the liquid medium into the first chamber.

As the medium used in the present invention, an organic low boiling point medium such as various chlorofluorocarbons, especially R245fa, and n-pentane can be used.

EFFECTS OF THE INVENTION

According to the present invention, the pressure threshold value obtained by adding the margin value to the saturated vapor pressure value of the medium calculated based on the temperature in a liquid phase portion of the gas retaining portion and the pressure value of a gas phase portion of the gas retaining portion are compared with each other, thereby intrusion of an air is detected. Therefore, it is possible to automatically detect the intrusion of the air into the medium flow path of the power plant. Moreover, the amount of the working medium released to the outside of the plant can be reduced. Also, it is possible to prevent reduction in the power generation efficiency caused by a lowered condensing performance of the condenser because of intrusion of an air not condensed by the condenser into the medium.

DESCRIPTION OF EMBODIMENTS

Embodiments of the present invention will be described below based on the drawings. First, description is now made to an example of the embodiment of the present invention based on FIGS. 1 to 6.

Figure 1A:
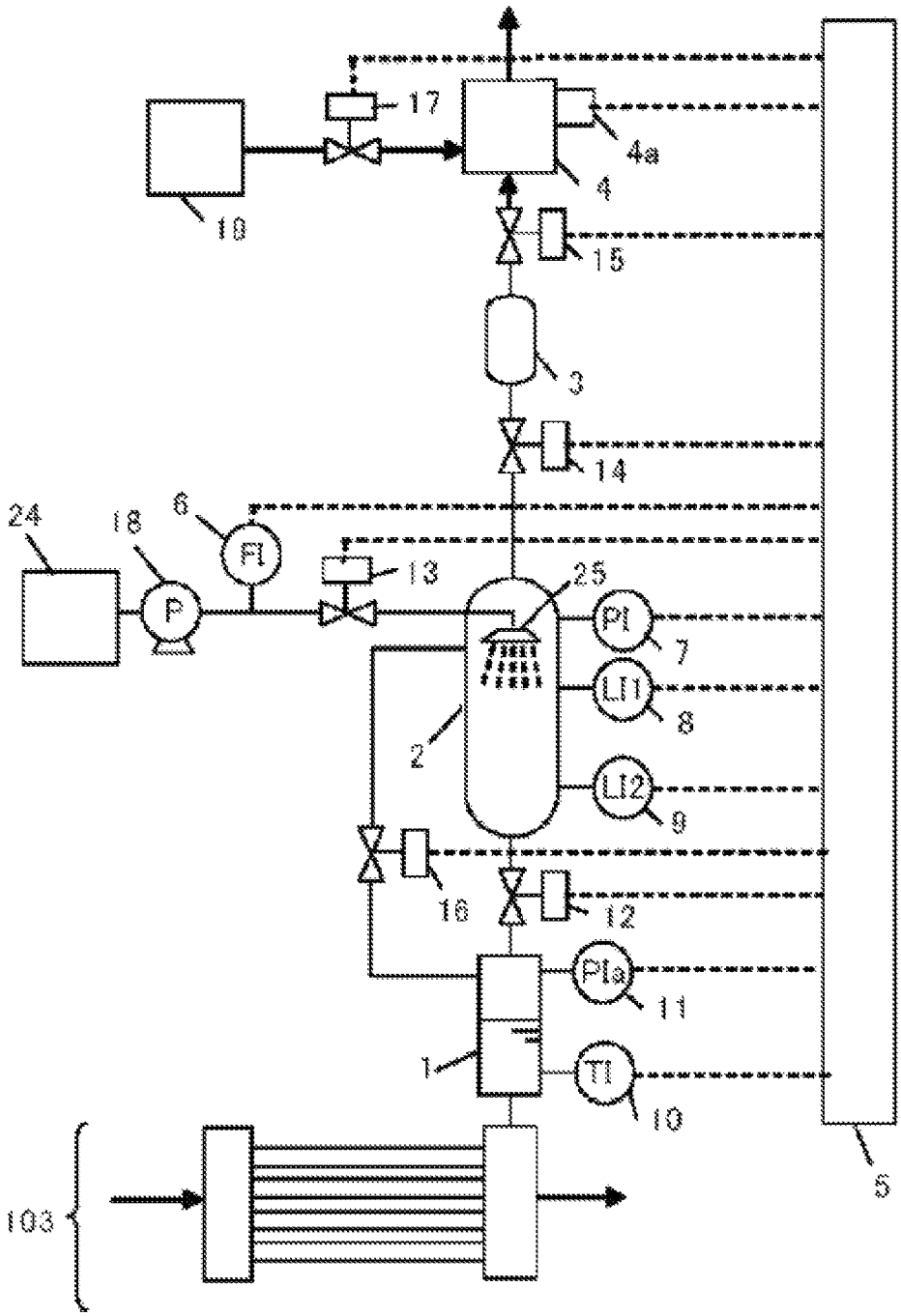
FIGS. 1A and 1B are diagrams showing the constitution of a plant according to examples of the present invention.
Figure 7:
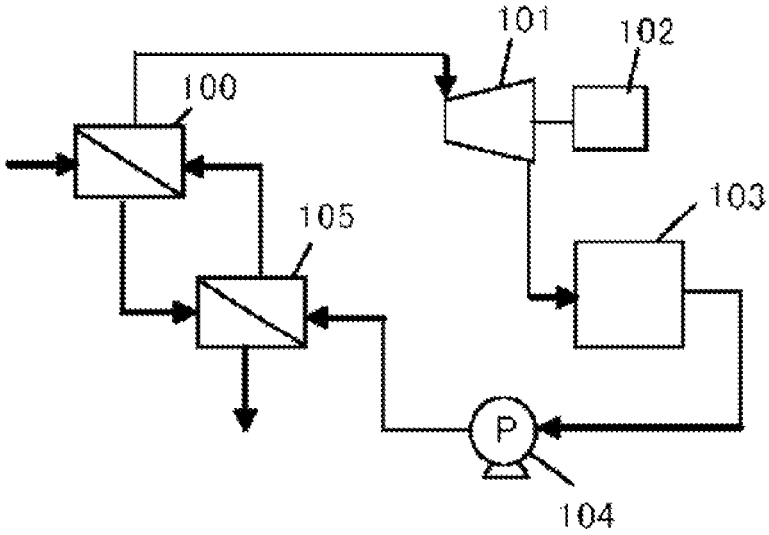
FIG. 7 is a diagram showing the constitution of a conventional power plant using a general medium having a low boiling point.

FIG. 1A is a diagram showing the constitution of an intruding air removing device according to an example of the present invention. A condenser 103 in FIG. 1 corresponds to the condenser 103 in FIG. 7. A gas retaining portion 1 is connected to an upper portion of an outlet-side collector of the condenser 103. An air intruding into a medium is collected into the gas retaining portion 1 via the outlet-side collector. To the gas retaining portion 1, a thermometer 10 for measuring the temperature in the gas retaining portion 1 and a pressure gauge 11 for measuring the pressure in the gas retaining portion 1 are provided.

A first chamber 2 is connected to the gas retaining portion 1 with a pipe via a valve 12. Moreover, a pipe is provided for connecting an upper portion of the first chamber 2 and the gas retaining portion 1 to each other. This pipe is provided with a valve 16. To the first chamber 2, a pressure gauge 7, a liquid level gauge (higher level) 8, and a liquid level gauge (lower level) 9 are provided in that order from the upper portion of the chamber.

A liquid medium feed pump 18 is connected to the inside of the first chamber 2 with a pipe via a flowmeter 6 for liquid pentane and a valve 13. At the outlet for the liquid pentane of this pipe, a spray nozzle 25 is provided.

A second chamber 3 is connected to an upper portion of the first chamber 2 with a pipe via a valve 14.

A combustor 4 is provided with combustion catalyst therein, and a lower portion of the combustor 4 is connected to the second chamber 3 with a pipe via a valve 15. An air supply means 19 is connected to the combustor 4 with a pipe via a valve 17. Pentane supplied from the second chamber 3 is mixed with an air supplied from the air supply means 19, and is burned by the combustion catalyst in the combustor 4 to produce an exhaust gas. The produced exhaust gas is released to the atmosphere. In the combustor 4, for making the combustion catalyst work, a heater 4*a* is provided which controls the combustion catalyst to a predetermined temperature. The combustor 4, the air supply portion 19, the valve 17 and the pipes connecting those are not essential components, but are unnecessary in a case where the gas released from the valve 15 is diluted by the atmosphere without being burned.

A controller 5 is connected to the thermometer 10, the pressure gauge 11, the pressure gauge 7, the liquid level gauge (higher level) 8, the liquid level gauge (lower level) 9, and the flowmeter 6 with signal lines, respectively. Signals from the instruments are respectively input to the controller 5. Moreover, the controller 5 is connected to the valves 12, 13, 14, 15, 16, and 17 with electric wires, respectively, to control opening and closing of the valves.

Figure 1B:
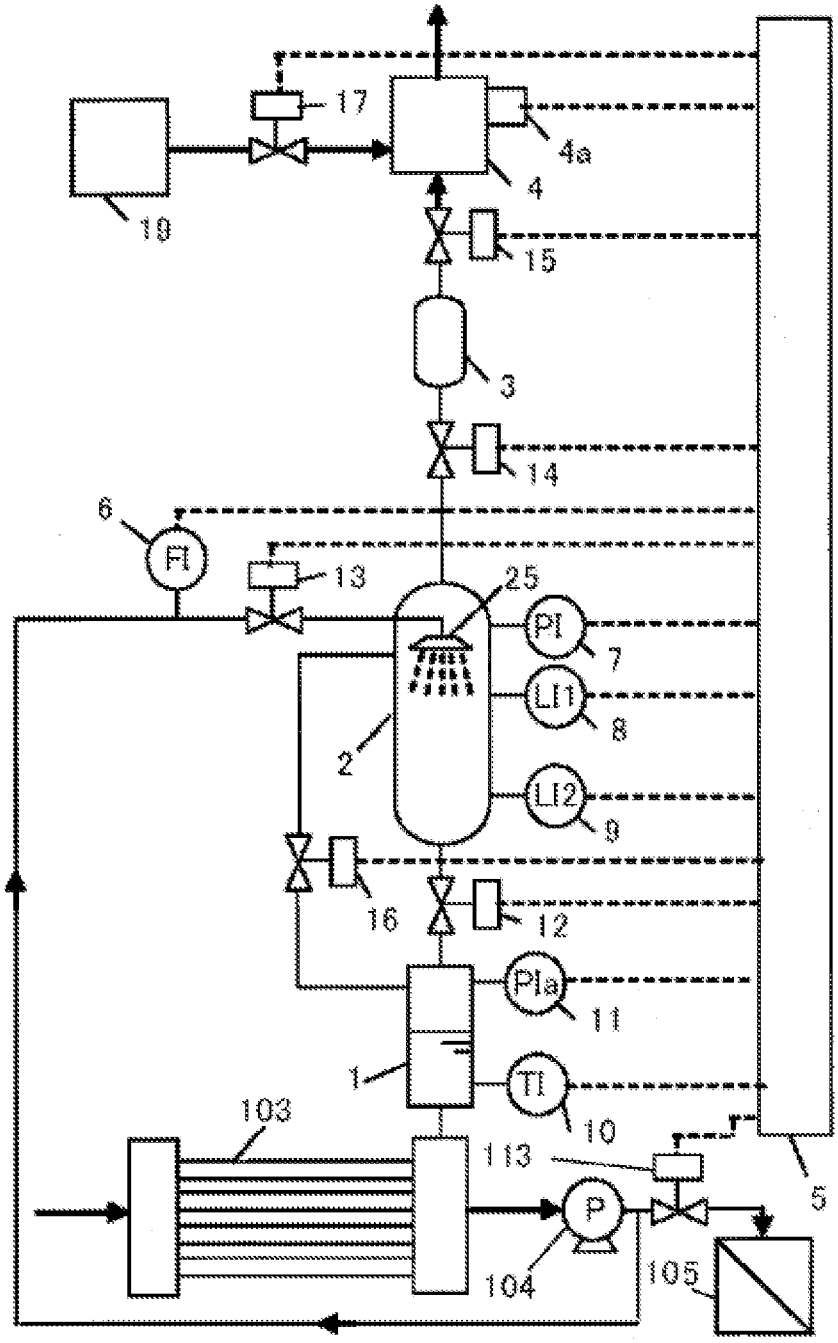

Another embodiment of this example may be configured to use the circulation pump 104 also as the liquid medium feed pump 18, as shown in FIG. 1B, substitute the pipe between the condenser 103 and the circulation pump 104 for a liquid medium tank 24, provide a valve 113 in the pipe at the outlet of the circulation pump 104, provide a pipe branching from a portion between this valve 113 and the circulation pump 104 and connecting to the first chamber 2, and provide the valve 13 in this branching pipe.

Figure 2:
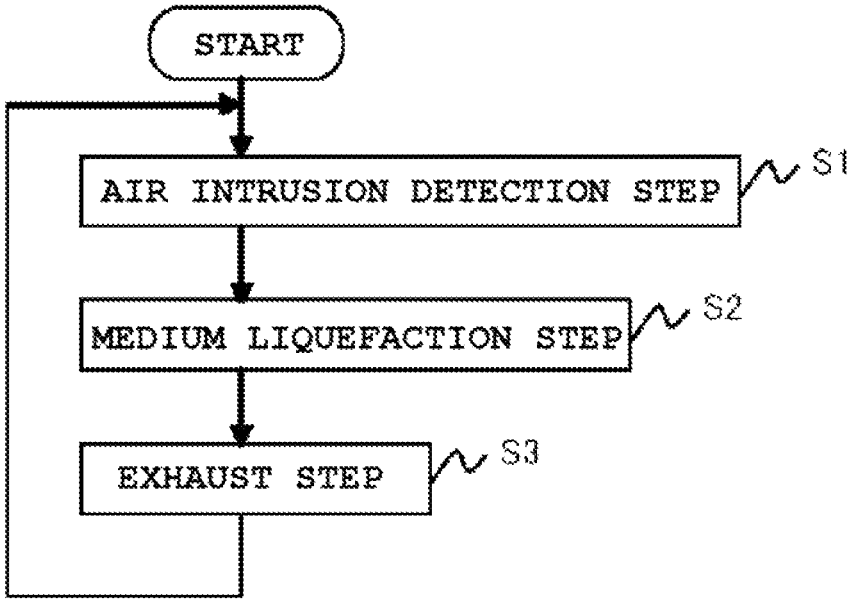
FIG. 2 is a diagram schematically showing an operational sequence of the plant according to the example of the present invention.
Figure 3:
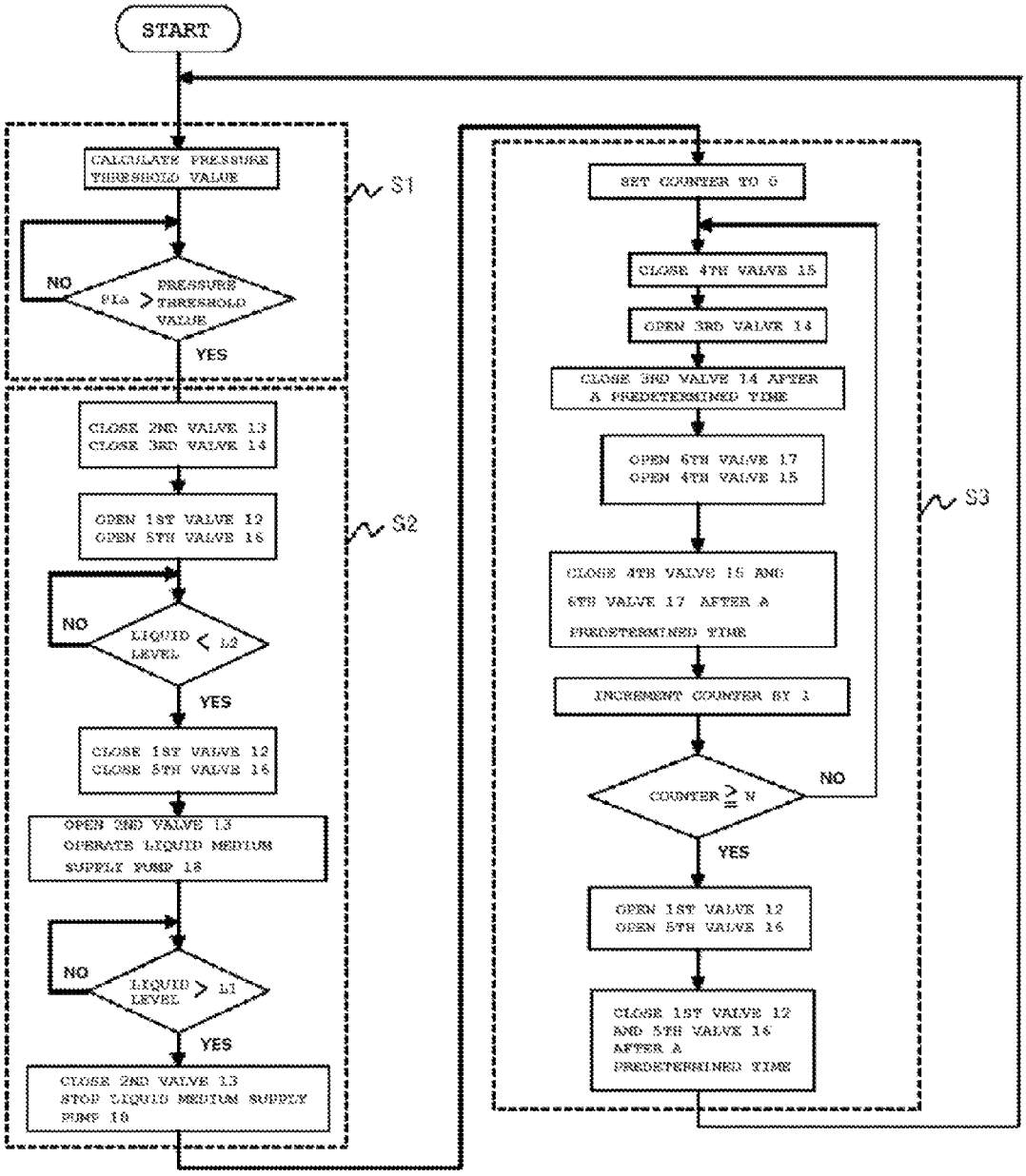
FIG. 3 is a diagram illustrating the details of the operational sequence of the plant according to the example of the present invention.
Figure 4:
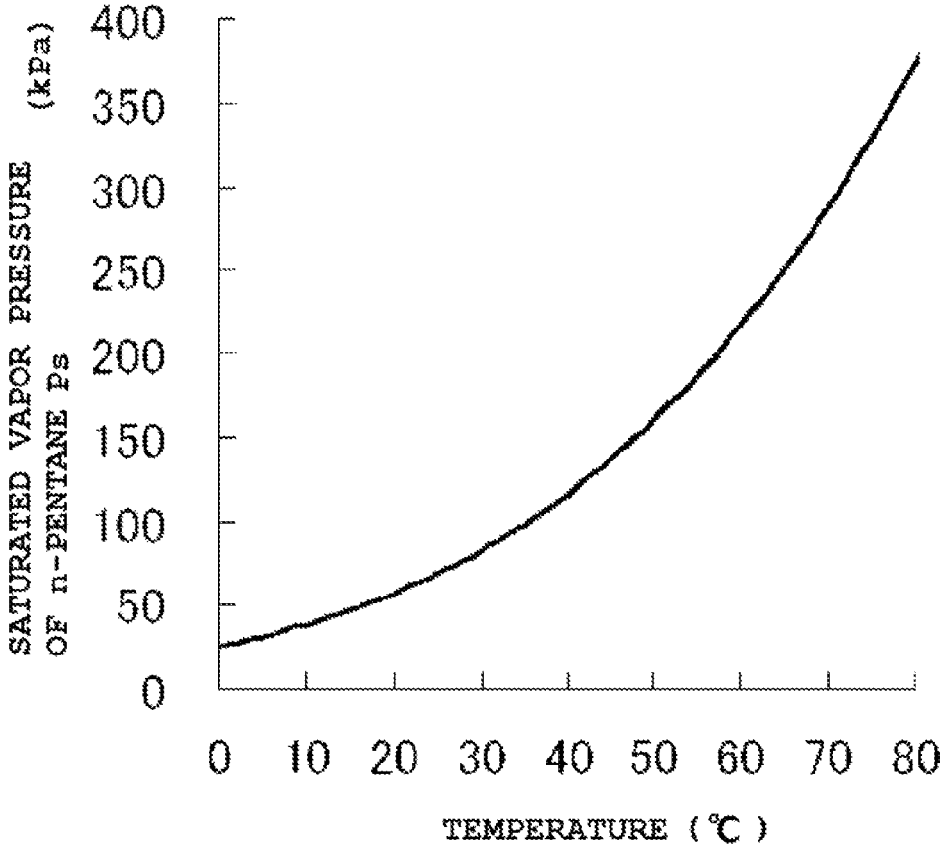
FIG. 4 is a graph of a saturated vapor pressure of n-pentane.

Next, an operation of this plant is described. FIGS. 2 and 3 are diagrams schematically showing an operational sequence of the plant according to the first embodiment of the present invention. The controller 5 performs an air intrusion detection step S1, a medium liquefaction step S2, and an exhaust step S3 in that order. After the exhaust step S3 is finished, the control flow loops back to the air intrusion detection step S1. The intruding air removing device may be configured to operate at all times. More desirably, the intruding air removing device may be operated only when it is confirmed that the pressure of the pressure gauge 11 has fallen to the atmospheric pressure or lower (in a case where the medium is n-pentane the medium temperature has fallen to 36° C. or lower) after the previous operation. This is because, if a condition where the pressure in the medium flow path is equal to or higher than the atmospheric pressure continues, it is difficult for an air to intrude into the medium flow path from the outside.

First, the air intrusion detection step S1 is described.

The controller 5 obtains the signal of the pressure gauge 11 provided in a gas phase portion of the gas retaining portion 1 and the signal of the thermometer 10 provided in a liquid phase portion of the gas retaining portion 1, and calculates a pressure threshold value obtained by adding a margin value (margin) to a saturated vapor pressure value of the medium calculated based on the temperature of the thermometer. If the pressure value of the pressure gauge 11 is equal to or less than the pressure threshold value, measurements of the pressure value and the temperature are continued. If the pressure value of the pressure gauge 11 is higher than the pressure threshold value, it is determined that an air has intruded into the medium and the control flow goes to the next step. The above-described margin value is set to a fixed value or a proportional value which is obtained by multiplying the aforementioned saturated vapor pressure value of the medium calculated based on the temperature of the thermometer by a coefficient. More specifically, the saturated vapor pressure (Ps) at a temperature (T1) is calculated using the following Equation 1.

$$Ps=0.0003(T1)^3+0.0159(T1)^2+1.1844(T1)+24.316 \quad \text{(Equation 1)}$$

The margin value is determined via several tests considering the number and conditions of joints. In case of the fixed value, for example, the margin value is set to about 10% of a value at 1 atmosphere. In case of the proportional value, the aforementioned coefficient is set to about 0.1.

Next, the medium liquefaction step S2 is described. In this step, an air-containing gas retained in the gas retaining portion is transferred to the first chamber 2, and the gas is compressed by supplying a liquid medium into the first chamber 2, so that the medium in the gas is liquefied and the amount of the medium in the gas is reduced.

More specifically, after a state where the respective valves 12, 13, 14, 15, 16, and 17 of the intruding air removing device shown in FIG. 1 are closed, the valves 12 and 16 are opened to transfer the air-containing gas from the gas retaining portion 1 to the first chamber 2. If a detection value of the liquid level gauge (lower level) 9 which measures the liquid level of the medium in the first chamber 2 is at a predetermined lower liquid level threshold value or higher, the state where the valves 12 and 16 are opened is continued. When the detection value of the liquid level gauge (lower level) 9 falls below the predetermined lower liquid level threshold value, the valves 12 and 16 are closed to seal the first chamber 2. Then, the valve 13 is opened and the liquid medium is supplied from the liquid medium tank 24 to the first chamber 2 by the liquid medium feed pump 18. During a period in which the detection value of the liquid level gauge (higher level) 8 is at a predetermined higher liquid level threshold value or lower, the state where the valve 13 is opened is continued.

When liquid pentane is introduced into the first chamber 2 to compress the air-containing gas, the gas temperature rises. This rise in temperature is given by the following Equation 2.

$$T2=T1\times[P2/P1](k-1)/mk \quad \text{(Equation 2)}$$

T2: Gas temperature after compression (K)
T1: Gas temperature before compression (K)
P2: Gas pressure after compression (MPa)
P1: Gas pressure before compression (MPa)
k: Specific heat ratio
m: Stage number of compression For example, when adiabatic compression of an air of 30° C. saturated with pentane is carried out from 101 kPa to 1 MPa, the temperature rise difference (ΔT) is 83° C. This rise in temperature can be suppressed by injecting liquid pentane which is made fine by the spray nozzle into the first chamber 2, instead of simply injecting liquid pentane into the first chamber 2. A portion of n-pentane saturated in the air-containing gas is cooled to be liquefied, and can be collected. Injection using the spray can reduce the temperature in the first chamber 2 more rapidly than in a method for injecting liquid pentane without spraying it.

When the detection value of the liquid level gauge (higher level) 8 exceeds the predetermined higher liquid level threshold value, the valve 13 is closed and the liquid medium feed pump 18 is stopped.

Next, the exhaust step S3 is described. First, a counter is initialized to 0. Then, the first chamber 2 and the second chamber 3 are made to communicate with each other, so that a portion of the gas compressed in the first chamber 2 is transferred to the second chamber 3. More specifically, a state where the valve 15 is closed and the valve 14 is opened is continued for a predetermined time. Then, the valve 14 is closed.

Subsequently, the gas is released from the second chamber 3 to the outside of the plant. At this time, the combustor 4, the air supply portion 19, the valve 17 and the pipes connecting those to one another are not essential components. For example, in a case where the gas released from the valve 15 is diluted by the atmosphere without being burned, the valve 15 may be opened to release the gas to the atmosphere as it is.

In a case where the gas is burned and is then released to the atmosphere, it is expected that the gas cannot be completely burned only by oxygen contained in the gas. In case of n-pentane, for example, when a ratio of mixing with an air exceeds the combustion range (1.5% to 7.8%) of n-pentane, oxygen has to be supplied. For adjusting the air amount to this range, an air is introduced via the valve 17. This air is desirably supplied from compressed air supply equipment. For example, an air for instrumentation for operating instrumentation devices of the plant may be used as this air. More specifically, the following procedure is performed. The combustor 4 is provided therein with a ceramic honeycomb filter carrying platinum fine particles as combustion catalyst. While the inside of the combustor 4 is heated to be at a temperature from 200° C. to 350° C. by the heater 4*a*, the valves 17 and 15 are opened to supply the gas and the air to the combustor 4, thereby the medium is burned. This state is continued for a predetermined time. Then, the valves 15 and 17 are closed. Subsequently, the counter is incremented by one. If the counter is less than N times which is a predetermined number of times, the procedure loops back, as shown in FIG. 3. If the counter is N times which is the predetermined number of times or more, the procedure goes out of this loop. The number N is appropriately set in accordance with the volume and pressure of the gas in the first chamber 2 after being compressed and the volume of the second chamber 3. To burn the gas in the combustor 4 is not essential for removing the air intruding into the medium flow path from the medium flow path. However, in a case of using combustible gas as the medium, the direct release of the gas to the atmosphere can be prevented.

Then, the pressure is released from the first chamber 2 to the gas retaining portion 1 and the medium is moved. More specifically, the valves 16 and 12 are opened and, after a predetermined time has passed, the valves 16 and 12 are closed. Then, the procedure loops back to the above-described air intrusion detection step S1.

Next, the reason why compressing the mixed gas of the air and the medium can reduce the amount of the medium in the mixed gas is described. The amount Fst of n-pentane saturated in an air is expressed by the following Equation 3.

$$Fst=Fa\times(Ps/(Pc-Ps)) \quad \text{(Equation 3)}$$

Fst: The amount of n-pentane which is saturated in an air at a temperature t in the standard state ($Nm^3$)
Fa: The amount of an air in the standard state ($Nm^3$)
Ps: The saturated vapor pressure of n-pentane at the temperature t (kPa)
Pc: The operation pressure (kPa)

Figure 5:
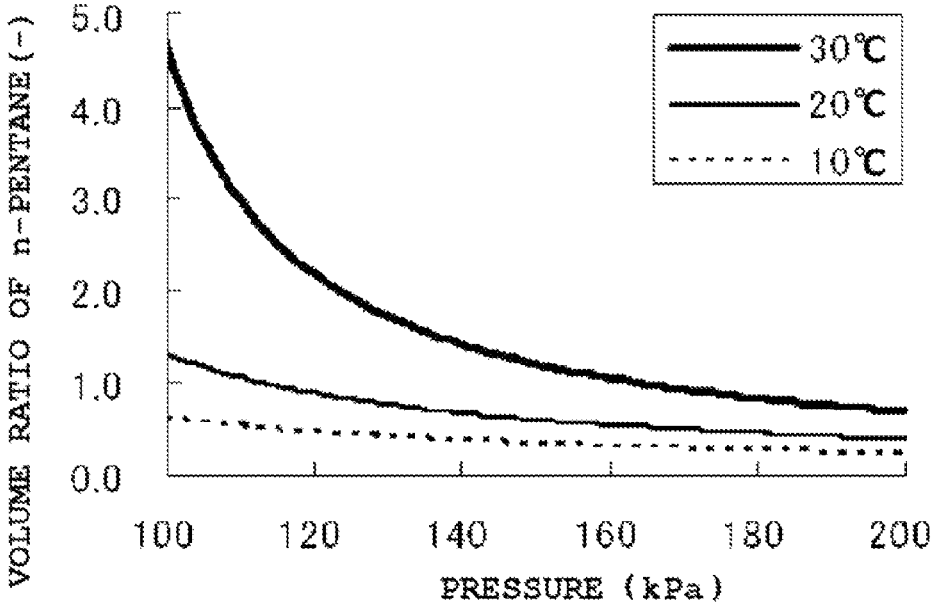
FIG. 5 is a diagram showing a volume ratio of n-pentane saturated in an air, using a pressure and a temperature as parameters.

The results of calculation are shown in FIG. 5, which was done from Equation 3 made with respect to the volume ratio of n-pentane saturated in an air using a pressure and a temperature as parameters. It is found from FIG. 5 that the higher the pressure is or the lower the temperature is, the less pentane saturated in the air is. Especially, it is found that increasing the pressure is extremely effective to reduction in n-pentane which is saturated in the air and brought to the outside of the system.

Figure 6:
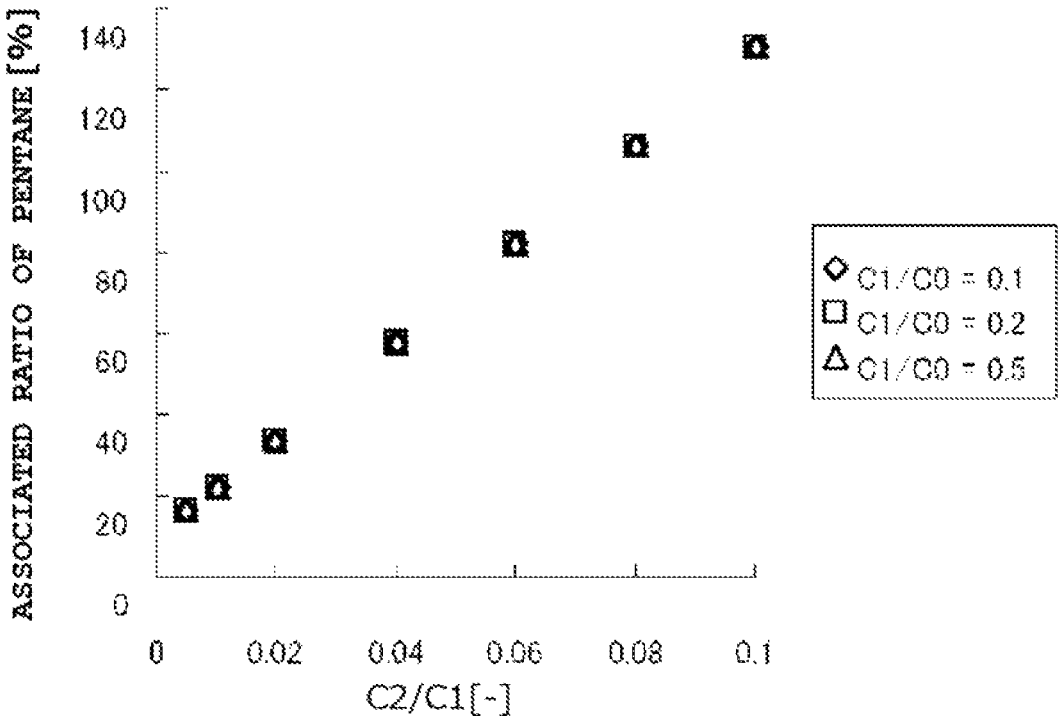
FIG. 6 is a diagram showing volume ratios of respective chambers of the plant according to the example of the present invention and an associated ratio of n-pentane.

Next, the description is made with respect to the loss amount of n-pentane. FIG. 6 is a diagram showing the relationship between the volume ratios of the respective chambers of the plant according to an example of the present invention and the associated ratio of pentane as an exemplary case where the temperature is kept constant at 30° C. C0 represents the volume of the gas retaining portion 1, C1 represents the volume of the first chamber 2, and C2 represents the volume of the second chamber 3. The amount of n-pentane burned in the combustor 4 is largely varied by a ratio of the volume C1 of the first chamber 2 and the volume C2 of the second chamber 3, and is therefore important in an operation management. More specifically, the air accumulated and compressed in the first chamber 2 is in a pressure state where the air is compressed and n-pentane is saturated. Then, when the valve 14 is opened to make the first chamber 2 and the second chamber 3 communicate with each other, the pressure in the first chamber 2 is reduced by the amount corresponding to the increase in the volume of the second chamber 3. Because of liquid pentane present in the first chamber 2, the amount of n-pentane in the gas is increased in accordance with Equation 3 by the amount corresponding to the reduction in pressure. This shows that the smaller the volume ratio (C2/C1) is, the less the amount of n-pentane released to the outside of the plant is. The ratio of C1/C0 has almost no effect on the associated pentane ratio.

DESCRIPTION OF THE REFERENCE NUMERALS

1: Gas retaining portion
2: First chamber
3: Second chamber
4: Combustor (filled with combustion catalyst)
4*a*: Heater
5: Controller
6: Flowmeter for liquid pentane
7: Pressure gauge of the first chamber
8: Liquid level gauge (higher level) of the first chamber
9: Liquid level gauge (lower level) of the first chamber
10: Thermometer of the gas retaining portion
11: Pressure gauge of the gas retaining portion
12, 13, 14, 15, 16, and 17: valves
18: Liquid medium feed pump
24: Liquid medium tank
25: Spray nozzle
19: Air supply portion
S1: Air intrusion detection step
S2: Medium liquefaction step
S3: Exhaust step
100: Vaporizer
101: Turbine
102: Electric generator
103: Condenser
104: Circulation pump
105: Preheater

The invention claimed is:

1. A power plant comprising:
a vaporizer configured to exchange heat between a medium having a lower boiling point than water and a geothermal heat source to generate a medium gas;
a turbine configured to receive a pressure of the medium gas supplied from the vaporizer to rotate;
an electric generator configured to be connected to the turbine;
a condenser configured to cool the medium gas discharged from the turbine, a cooling source of the condenser being the atmosphere;
a circulation pump configured to supply the medium discharged from the condenser to the vaporizer;
a medium flow path configured to pass through the vaporizer, the turbine, the condenser, and the circulation pump; and
an air removing device configured to remove air intruding into the medium, the air removing device comprising:
a gas retaining portion provided on an outlet side of the condenser and configured to retain a gas in the medium,
a pressure gauge configured to measure a pressure in the gas retaining portion,
a thermometer configured to measure a temperature in the gas retaining portion,
a controller configured to calculate a pressure threshold value based on a saturated vapor pressure value of the medium calculated using the temperature of the thermometer, and compare a pressure value of the pressure gauge and the pressure threshold value to determine whether or not the air has intruded into the medium, and
a releaser configured to release the gas in the gas retaining portion when it is determined that the air has intruded, the releaser including
a first chamber to which the gas retained in the gas retaining portion is transferred when the controller determines that the air has intruded,
a medium supplier configured to supply a liquid medium to the first chamber to compress the gas, the gas remaining in the first chamber being released after the medium is supplied, the medium supplier including
a liquid medium tank configured to store the liquid medium, and
a liquid medium feed pump configured to supply the liquid medium from the liquid medium tank to an inside of the first chamber,
a first valve provided in a pipe connecting the gas retaining portion and a lower portion of the first chamber,
a second valve provided in a pipe connecting the liquid medium feed pump and the first chamber,
a third valve provided in a pipe connecting an upper portion of the first chamber to a second chamber,
a fourth valve configured to release the gas from the second chamber, and
a fifth valve provided in a pipe connecting the gas retaining portion to the upper portion of the first chamber.

2. The power plant according to claim 1, wherein, when determining that the air has intruded,
the controller controls the second valve and the third valve to be closed and the first valve and the fifth valve to be opened so that the gas in the gas retaining portion is transferred to the first chamber, and then controls the first valve and the fifth valve to be closed, the second valve to be opened, and the liquid medium feed pump to supply the liquid medium to the first chamber so that the gas is compressed, and
subsequently the controller controls the third valve to be opened while the fourth valve is closed so that the gas in the first chamber is transferred to the second chamber, and then controls the third valve to be closed and the fourth valve to be opened so that the gas in the second chamber is released to an outside of the second chamber.

3. The power plant according to claim 1, further comprising:
a combustor configured to burn the medium remaining in the gas released from the second chamber; and
an air supply portion configured to supply an air to the combustor.

4. The power plant according to claim 3, further comprising a sixth valve provided in a pipe connecting to the combustor to the air supply portion, the controller controlling opening degrees of the fourth valve and the sixth valve to adjust a flow rate.

5. The power plant according to claim 2, comprising:
a combustor configured to burn the medium remaining in the gas released from the second chamber; and
an air supply portion configured to supply air to the combustor.

6. The power plant according to claim 1, wherein the controller determines that the air has intruded when the pressure value of the pressure gauge is larger than the pressure threshold value.

7. The power plant according to claim 2, wherein the controller determines that the air has intruded when the pressure value of the pressure gauge is larger than the pressure threshold value.

8. The power plant according to claim 3, wherein the controller determines that the air has intruded when the pressure value of the pressure gauge is larger than the pressure threshold value.

9. The power plant according to claim 4, wherein the controller determines that the air has intruded when the pressure value of the pressure gauge is larger than the pressure threshold value.

* * * * *